US008205753B2

(12) United States Patent
Pedain et al.

(10) Patent No.: US 8,205,753 B2
(45) Date of Patent: Jun. 26, 2012

(54) FLOTATION REAGENT FOR SILICATES

(75) Inventors: Klaus-Ulrich Pedain, Dietzenbach-Steinberg (DE); Tobias Rau, Dortmund (DE)

(73) Assignee: Clariant Finance (BVI) Limited, Tortola (VG)

( * ) Notice: Subject to any disclaimer, the term of this patent is extended or adjusted under 35 U.S.C. 154(b) by 895 days.

(21) Appl. No.: 12/225,012

(22) PCT Filed: Feb. 26, 2007

(86) PCT No.: PCT/EP2007/001628

§ 371 (c)(1), (2), (4) Date: Sep. 9, 2008

(87) PCT Pub. No.: WO2007/101575

PCT Pub. Date: Sep. 13, 2007

(65) Prior Publication Data

US 2009/0114573 A1 May 7, 2009

(30) Foreign Application Priority Data

Mar. 9, 2006 (DE) ..... 10 2006 010 939

(51) Int. Cl.
*B03D 1/01* (2006.01)
*B03D 1/02* (2006.01)

(52) U.S. Cl. ..... 209/166

(58) Field of Classification Search ..... 209/166; 252/61

See application file for complete search history.

(56) References Cited

U.S. PATENT DOCUMENTS

| | | | | |
|---|---|---|---|---|
| 2,389,763 | A | 11/1945 | Cahn | |
| 3,363,758 | A * | 1/1968 | Cronberg et al. | 209/166 |
| 3,398,197 | A | 8/1968 | Miller et al. | |
| 3,459,649 | A | 8/1969 | Mueller et al. | |
| 3,834,533 | A | 9/1974 | McGuire et al. | |
| 4,070,276 | A | 1/1978 | Broman et al. | |
| 4,168,227 | A * | 9/1979 | Polgaire et al. | 209/166 |
| 4,235,811 | A | 11/1980 | Schulze et al. | |
| 4,278,533 | A | 7/1981 | Hefner | |
| 4,287,052 | A * | 9/1981 | Hefner et al. | 209/166 |
| 4,304,690 | A | 12/1981 | Schulze et al. | |
| 4,319,987 | A | 3/1982 | Shaw et al. | |
| 4,325,821 | A | 4/1982 | Escalera | |
| 4,830,739 | A | 5/1989 | Hellsten et al. | |
| 4,900,431 | A | 2/1990 | Volpi et al. | |
| 4,995,965 | A | 2/1991 | Mehaffey et al. | |
| 4,995,998 | A | 2/1991 | Von Rybinski et al. | |
| 5,182,039 | A | 1/1993 | Miller et al. | |
| 5,261,539 | A | 11/1993 | Hancock et al. | |
| 5,439,116 | A | 8/1995 | Van Lierde et al. | |
| 5,540,336 | A | 7/1996 | Schreck et al. | |
| 5,540,337 | A | 7/1996 | Riggs et al. | |
| 5,720,873 | A | 2/1998 | Klingberg et al. | |
| 6,076,682 | A * | 6/2000 | Gustafsson et al. | 209/166 |
| 6,617,303 | B1 * | 9/2003 | Smith et al. | 510/499 |
| 2009/0152174 | A1 | 6/2009 | Pedian et al. | |

FOREIGN PATENT DOCUMENTS

| | | |
|---|---|---|
| DE | 12 59 264 | 1/1968 |
| DE | 26 01 068 | 7/1976 |
| DE | 41 33 063 | 4/1993 |
| DE | 38 78 440 | 9/1993 |
| EP | 0 310 720 | 4/1989 |
| FR | 1 469 430 | 2/1966 |
| FR | 2 700 976 | 8/1994 |
| GB | 1 343 957 | 1/1974 |
| GB | 2 150 049 | 6/1985 |
| WO | WO 93/06935 | 4/1993 |
| WO | WO 00/62937 | 10/2000 |

OTHER PUBLICATIONS

International Search Report for PCT/EP2007/001628, dated May 16, 2007.

International Preliminary Examination Report for PCT/EP2007/001628, dated May 16, 2007.

International Search Report for PCT/EP2007/003325, dated Sep. 19, 2007.

Translation of International Preliminary Examination Report for PCT/EP2007/003325, dated Sep. 19, 2007.

* cited by examiner

*Primary Examiner* — Thomas M Lithgow
(74) *Attorney, Agent, or Firm* — Tod A. Waldrop

(57) ABSTRACT

This invention relates to the use of a compound of the formula (I) where $R^1$ is a hydrocarbon group having 1-40 carbon atoms, $R^2$ is an aliphatic hydrocarbon group having 2-4 carbon atoms, and also $R^3$ is an alkoxy group, n is in the range from 1 to 50, and m is 1 or 2, as flotation reagent in silicate flotation $$R^1—O—R^2—NH_{(2-m)}—[(R^3)_n—H]_m \quad (I).$$

11 Claims, No Drawings

FLOTATION REAGENT FOR SILICATES

The present invention relates to the use of collectors in the flotation treatment of silicate-containing minerals and ores, in particular iron ore, using fatty alkyl ether alkylamine alkoxylate.

Many naturally occurring ores and minerals contain silicate as unwanted accompanying mineral. These include, in addition to iron ore, calcite, phosphate ore and feldspar. In particular in the case of iron ore, the silicate content reduces the quality of the iron ore and interferes in iron production. In order to obtain high-quality iron ore, it is of interest to reduce the silicate content of the iron ore to below 2%. Customarily, the iron ore, in addition to magnetic separation, is separated from the silicate by inverse flotation. For this the ground iron ore is brought together in a flotation cell with water and flotation reagents, wherein the silicate, by the use of a collector, is discharged with the froth, whereas the iron ore remains in what is termed the pulp.

Silicate collectors which are used are, for example, fatty amines, alkyl ether amines and alkyl ether diamines. These are known under the trade name Flotigam®.

Alkyl ether amines and alkyl ether diamines are mainly used in their partially neutralized forms as partial acetates, as described in U.S. Pat. No. 4,319,987. The reason for this is the improved solubility of the partially neutralized amine functions.

U.S. Pat. No. 6,076,682 describes the combined use of alkyl ether monoamine with alkyl ether diamine for the silicate flotation from iron ore.

In WO 00/62937, the use of quaternary amines for the flotation of iron ore is disclosed.

In WO-93/06935, the synergistic action of ether amines and anionic collectors for iron ore flotation is described.

Silicate flotation, inter alia from iron ore, using alkyloxyalkanamines is described in U.S. Pat. No. 5,540,337.

The collectors which are described in the prior art for silicate flotation, however, exhibit inadequate selectivity and yield. The object of the present invention was therefore to provide an improved collector for silicate flotation.

Surprisingly, it was found that the use of fatty alkyl ether alkylamine alkoxylates leads to a marked improvement of silicate flotation from iron ore compared with the known flotation reagents.

The present invention therefore relates to the use of a compound of the formula (I)

$$R^1—O—R^2—NH_{(2-m)}—[(R^3)_n—H]_m \quad (I)$$

where $R^1$ is a hydrocarbon group having 1-40 carbon atoms, $R^2$ is an aliphatic hydrocarbon group having 2-4 carbon atoms, and also $R^3$ is an alkoxy group, n is a number between 1 and 50, and also m is 1 or 2, as flotation reagent in silicate flotation.

The collector according to the invention can be used alone or in combination with other nitrogenous compounds for the flotation of silicate, in particular from iron ore or calcite. Preferred nitrogenous compounds are alkyl ether amines, alkyl ether diamines, alkylamines or quaternary ammonium salts.

The invention further relates to a process for the flotation of silicate-containing material, by bringing the flotation reagent according to the invention into contact with the silicate-containing mineral.

The invention further relates to a composition containing 1 to 99% by weight of a collector for silicate flotation, which collector is an alkyl ether amine, alkyl ether diamine, alkylamine or quaternary ammonium salt, and also 1 to 99% by weight of a compound of the formula I.

The ratio of alkyl ether amine, alkyl ether diamine, alkylamine or quaternary ammonium salt to the compound of the formula I is preferably between 98:2 and 75:25.

In a preferred embodiment, $R^1$ is an aliphatic hydrocarbon group. It is further preferred that $R^1$ comprises 4 to 22, in particular 6 to 20, and especially 8 to 14, carbon atoms. Particular preference is given to 2-ethylhexyl, isononane, isodecane and isotridecane radicals.

In a further preferred embodiment, $R^2$ is a $C_2H_4$ or $C_3H_6$ group.

In a further preferred embodiment, $R^3$ is a $C_2C_4$ alkoxy group, in particular an ethoxy or propoxy group. $R^3$ can also be a mixed alkoxy group.

In a further preferred embodiment, n is a number between 2 and 40.

In a further preferred embodiment, m is 2.

A particularly preferred embodiment of the invention is a compound of the formula I where $R^1$ is an isotridecane radical, $R^2$ is $C_3H_6$, $R^3$ is $C_2H_4$—O, n is 2 to 10 and m is 2.

The collectors for silicate flotation which are an alkyl ether amine, alkyl ether diamine, alkylamine or quaternary ammonium salt and those which can be used together with a compound of the formula I are preferably one or more of the compounds of the formulae (II) to (V).

These compounds are $$R^4—O—R^5—NH_2 \quad (II)$$

where $R^4$ is a hydrocarbon group having 1-40, preferably 8 to 32, carbon atoms and $R^5$ is an aliphatic hydrocarbon group having 2-4 carbon atoms;

$$R^6—O—R^7—NH—R^8—NH_2 \quad (III)$$

where $R^6$ is a hydrocarbon group having 1-40, preferably 8 to 32, carbon atoms, $R^7$ and $R^8$ are one or different aliphatic hydrocarbon groups having 2-4 carbon atoms;

$$(R^9R^{10}NR^{11}R^{12})^+A^- \quad (IV)$$

where $R^9$, $R^{10}$, $R^{11}$ and $R^{12}$ are one or different hydrocarbon groups having 1-22 carbon atoms and $A^-$ is a suitable anion;

$$R^{13}—NH_2 \quad (V)$$

where $R^{13}$ is a hydrocarbon group having 1-40, preferably 8 to 32, carbon atoms.

The use of the flotation reagent according to the invention can also proceed in combination with frothers and depressants as are known from the prior art. In order to avoid iron ore being discharged in conjunction in the silicate flotation, preferably hydrophilic polysaccharides such as, for example, modified starch, carboxymethylcellulose, or gum arabic, are added as depressants in dosages of 10 to 1000 g/t.

Silicate flotation is preferably carried out at a pH of 7-12, in particular 8-11, which is set, for example, using sodium hydroxide.

EXAMPLES

The table hereinafter presents the flotation results of the collector according to the invention compared with the standard reagent. Flotation experiments have been carried out on a silicate-containing iron ore.

The standard reagent used (comparative examples 1 (C) to 3 (C)) was a $C_{10}$-alkyloxypropylamine, which corresponds to a compound of the formula (II) wherein $R^4$ is a decyl group and $R^5$ is a propyl group. The collector B according to the invention (examples 4 to 7) corresponds to the reagent according to the invention of the formula (I) where $R^1$ is $C_{13}$-alkyl, $R^2$ is propyl and $R^3$ is ethoxy, and also m is 2 and n is 5. Examples 8 to 10 present the synergistic effect linked with the simultaneous use of collector according to the invention and collector of the prior art, wherein collector C corresponds to a mixture of 10% collector B and 90% of the standard collector A. The content of the crude ore was 65.7% Fe.

TABLE 1

Effectiveness of the collector B according to the invention compared with the standard collector A

| Example | Collector | Dosage in g/t | Recovery of Fe in % | Content of Fe in % |
|---|---|---|---|---|
| 1 (C) | A | 50 | 83.8 | 68.2 |
| 2 (C) | A | 70 | 80.8 | 68.7 |
| 3 (C) | A | 110 | 67.2 | 69.3 |
| 4 | B | 50 | 89.6 | 67.6 |
| 5 | B | 70 | 82.6 | 68.3 |
| 6 | B | 90 | 76.2 | 68.9 |
| 7 | B | 110 | 69.4 | 69.2 |
| 8 | C | 60 | 88.0 | 68.4 |
| 9 | C | 90 | 80.6 | 68.9 |
| 10 | C | 120 | 83.9 | 68.6 |

The results show a consistently increased percentage recovery for a roughly constant Fe content by means of the flotation reagent B according to the invention compared with the standard collector A. The mixture C comprising 10% of the collector B according to the invention and 90% of the standard collector A also shows a significantly increased recovery compared with the standard collector A.

The flotation reagent according to the invention can be used in a wide pH range, for example 7 to 12, preferably 8 to 11, and is added to the aqueous pulp in a concentration between preferably 0.001 and 1.0 kg/ton of crude mineral.

Using the flotation reagent according to the invention, compared with the collectors of the prior art, a significant improvement of recovery and selectivity is achieved. Examples 1 to 10 show that the Fe recovery is significantly higher than with the corresponding standard reagent.

The invention claimed is:

1. A method for flotation of a silicate-containing mineral, wherein the method comprises the step of contacting the silicate-containing mineral with a flotation reagent comprising a compound of the formula (I)

$$R^1—O—R^2—NH_{(2-m)}—[(R^3)_n—H]_m \quad (I)$$

where $R^1$ is an aliphatic hydrocarbon group having 8-22 carbon atoms, $R^2$ is an aliphatic hydrocarbon group having 2-4 carbon atoms, and also $R^3$ is an alkoxy group, n is a number between 1 and 50, and also m is 1 or 2.

2. The method of claim 1, wherein $R^1$ is an aliphatic hydrocarbon radical having 8 to 14 carbon atoms.

3. The method of claim 1, wherein $R^1$ is a radical selected from the group consisting of 2-ethylhexane, isononane, isodecane and isotridecane radical.

4. The method of claim 1, where $R^1$ is an isotridecane radical, $R^2$ is $C_3H_6$, $R^3$ is $C_2H_4$—O, n is 2 to 10 and m is 2.

5. A method for the flotation of silicate from iron ore, wherein the method comprises the step contacting the iron ore with a flotation reagent comprising a compound of the formula (I)

$$R^1—O—R^2—NH_{(2-m)}—[(R^3)_n—H]_m \quad (I)$$

where $R^1$ is an aliphatic hydrocarbon group having 8-22 carbon atoms, $R^2$ is an aliphatic hydrocarbon group having 2-4 carbon atoms, and also $R^3$ is an alkoxy group, n is a number between 1 and 50, and also m is 1 or 2, and a further nitrogenous silicate collector at a pH of 7-12, where the further nitrogenous silicate collector is selected from the group consisting of alkyl ether amines, alkyl ether diamines, alkylamines and quaternary ammonium salts.

6. The method of claim 1, wherein the silicate-containing mineral is iron ore.

7. The method of claim 1, wherein the silicate-containing mineral is selected from the group consisting of iron ore, calcite, phosphate ore and feldspar.

8. The method of claim 1, wherein the silicate-containing mineral comprises a finite amount of silicate between 0 and 90% silicate.

9. The method of claim 1, wherein the flotation reagent further comprises a frother or a depressant or a mixture thereof.

10. The method of claim 1, wherein said contacting occurs in a pH range of 7 to 12.

11. The method of claim 1, wherein the flotation reagent is present in an amount of 0.001 to 1.0 kg per ton of crude ore.

* * * * *